United States Patent [19]

Lowther

[11] 4,330,732

[45] May 18, 1982

[54] PLASMA CERAMIC COATING TO SUPPLY UNIFORM SPARKING ACTION IN COMBUSTION ENGINES

[75] Inventor: Frank E. Lowther, Buffalo, N.Y.

[73] Assignee: Purification Sciences Inc., Geneva, N.Y.

[21] Appl. No.: 130,577

[22] Filed: Mar. 14, 1980

[51] Int. Cl.[3] ..... F02P 13/00; F02F 3/14

[52] U.S. Cl. ..... 313/130; 123/143 R; 123/146.5 R; 123/169 E; 123/193 CP; 313/141

[58] Field of Search ..... 313/118, 128, 130, 131 A, 313/141, 142, 126; 123/143 R, 146.5 R, 169 R, 169 E, 169 EL, 193 CP, 193 P, 668

[56] References Cited

U.S. PATENT DOCUMENTS

| | | | |
|---|---|---|---|
| 2,900,547 | 8/1959 | Engel | 313/142 X |
| 3,534,714 | 10/1970 | Urlaub | 123/193 P X |
| 3,673,452 | 6/1972 | Brennen | 313/141 |

*Primary Examiner*—Eugene R. La Roche
*Attorney, Agent, or Firm*—Robert J. Bird

[57] ABSTRACT

The present invention provides a hot spark that is more-or-less uniform over the combustion chamber volume in a liquid oxidant/liquid fuel combustion engine. In addition, heat losses are reduced and low wear/low friction surfaces are provided. Flame sprayed ceramic coatings are utilized to provide all embodiments of the present invention.

5 Claims, 8 Drawing Figures

PLASMA CERAMIC COATING TO SUPPLY UNIFORM SPARKING ACTION IN COMBUSTION ENGINES

BACKGROUND OF THE INVENTION

Prime mover engines powered by gasoline or other petroleum-derived fuels are among the most important machines in modern society. The basic characteristics of these prime mover engines were determined many years ago when the importance of atmospheric pollution was not recognized and when oil was cheap and plentiful. These conditions are no longer true and today's prime mover engines are completely inadequate for requirements of the times. Strict exhaust emission standards have been adopted as law, oil prices are escalating, and future supplies are uncertain; and no alternate fuel will be available (in the immediate future) to replace oil. It follows that cleaner burning and more efficient oil-derived fueled combustion engines must be developed.

This invention relates to efficient and low pollution prime mover engines of the hydrocarbon-fueled, spark-ignited combustion type. In particular, it relates to methods and apparatus wherein an ignition spark is applied more-or-less uniformly over the combustion chamber volume as opposed to the prior art "point" spark plug device. Additional side benefits accrue: reduction in piston-cylinder wear and friction loss, improved efficiency via reduced heat loss, improved sealing against high pressure gas loss, etc. Preferably, the present invention is applied to the high efficiency engine wherein the fuel oxidizing agent is supplied by a stored liquid chemical as opposed to the use of atmospheric air. Both reciprocating piston and rotary engines may be used.

PRIOR ART DESCRIPTION

The combustible mixture in a reciprocating internal combustion engine must be ignited (initiation of combustion) once each power cycle. The Diesel engine utilizes heat of compression for ignition while the Otto (gasoline) engine requires a high voltage spark. The 16:1 compression ratio typical of Diesels brings the gas temperature to over 1000° F. at the end of compression and before the fuel is injected. Gas temperatures of about 700° F. at the end of compression are typical for the gasoline engine with its 8:1 compression ratio. The vast majority of the internal combustion engines in service today are either compression ignited or spark ignited as described above. Combination engines are in widespread service. For example, ignition aids (spark plugs, glow plugs, etc.) may be utilized in compression ignition engines for cold start purposes. Some large Diesel engines will employ smaller gasoline engines (spark ignited) for starting purposes.

Certain practical problems have long plagued the prior art spark ignition devices for internal combustion engines. The generation and control of a high voltage arc or spark, precisely timed to the engine RPM, is difficult, complex, and expensive. Ideally, the hot spark would be evenly distributed over the entire combustion chamber volume which typically measures at least several cubic inches. However, practical limitations in the prior art restricts sparking activity to the small volume defined by the spark plug electrodes and, typically, is only several hundredth's of a cubic inch. Knock and other undesirable side effects occur as the result of "nonuniform" sparking action. For example, the exhaust valve area may, in fact, be hotter or otherwise a better ignition point than is the spark plug. Attempts have been made in the prior art to produce an electrical discharge which is more-or-less uniform over the combustion chamber volume. However, these attempts have failed for two reasons. First, the piston, cylinder, and cylinder head must be electrically insulated from one another in order to properly control the area electrical discharge (corona). This is in direct violation of the good thermal paths needed by the low efficiency prior art engines to get the heat out. Secondly, the area corona discharge is much cooler than the point spark discharge. The available electrical energy is simply spread too diffusely to be an effective ignition aid.

A good deal of the complexity in fuel technology for gasoline engines as well as many of the engine features themselves can be traced directly to the "point" spark ignition source. Fuel grade and knock characteristics, combustion wave propagation time, combustion chamber size and shape, spark timing and similar aspects take on new meaning and importance if an effective, hot area spark were to be available.

SUMMARY OF THE INVENTION

A principal object of the present invention is to overcome the defects of prior art combustion engine ignition systems as described above.

It is one object of this invention to provide an ignition spark that is more-or-less uniform in energy density over the entire combustion chamber volume. Rotary and reciprocating combustion engines are included.

It is yet another object of this invention to reduce friction and wear between moving members in expansible chamber combustion engines of the rotary and reciprocating types.

It is yet another object of this invention to improve engine efficiency by thermally insulating the combustion and expansible chambers from ambient.

It is yet another object of this invention to provide a degree of hot gas oxidation and sulfidation protection for the structural members of the combustion and expansible chambers.

These and other objects and features of the invention will be apparent to a skilled scientist by reference to the following description and in the drawing.

DETAILED DESCRIPTION

It is necessary to understand the basic features of flame sprayed ceramic coatings in order to describe the present invention. The following brief outline of flame sprayed coatings was taken from "Metals Handbook," 8th. edition, Vol. 2—ASTM, pp. 591–594.

Most of the ceramic coatings currently being used can be applied by flame spraying. Silicates, silicides, oxides, carbides, borides, and nitrides are among the principal materials deposited by this process.

The three methods of heating and propelling the particles in the plastic condition to the substrate surface are combustion flame spraying, plasma-arc flame spraying, and detonation-gun spraying. The first two methods utilize coating materials in powder or rod form. Detonation-gun spraying uses only powder materials. Flame-sprayed coatings can be applied to a wide range of sizes and shapes. Most all metals that can be adequately cleaned, textured by standard abrasive blasting equipment, and safely heated to 400° F. are capable of being coated. Satisfactory coatings have been applied to wires 0.004 inches in diameter, to ¼ inch diameter throat rocket nozzles ½ inch in length, and to large ducts 6 feet in diameter by 27 feet long.

Of the three processes, only the plasma-arc method will be described. A gas or a mixture of gases (such as argon, hydrogen or nitrogen) is fed into the arc chamber of the plasma generator and heated by an electric arc struck between an electrode and a nozzle. The gas is heated to temperatures as high as 15,000° F. to form a plasma (ionized gas) that is accelerated through the nozzle. The ceramic powder, carried by the gas stream, is injected into the hot plasma, where it is heated, melted, and propelled toward the workpiece. The process can be used to apply metallic coatings as well as ceramic coatings.

The plasma coating thickness can be controlled to about 2 mils. In applications where precision is important the ceramic coating can be lapped to about any practical tolerance desired. By the nature of the process, the ceramic coating will be porous with voids representing a fraction of 1% of the total volume. This porosity is of direct use in the present invention.

Flame sprayed ceramic coatings are among the hardest and longest wearing surfaces available today. In addition, protection from hot corrosive gases is provided within the limits of the pores problem. Typical commercial applications include roller coatings in steel rolling mills, bucket coatings in gas turbines, coating of Diesel valve push rod shafts; with this background we proceed to describe the present invention.

Figure 1:
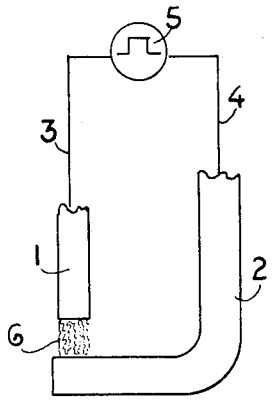
FIG. 1 is a sketch of the electrode geometry of a typical spark plug.

FIG. 1 shows the electrode structure of a conventional spark plug. Electrodes 1 and 2 are connected to a pulsed source of high voltage 5 by conductors 3 and 4. A hot spark discharge 6 will appear, coincidentally with the pulsed voltage in the small interelectrode volume.

Figure 2:
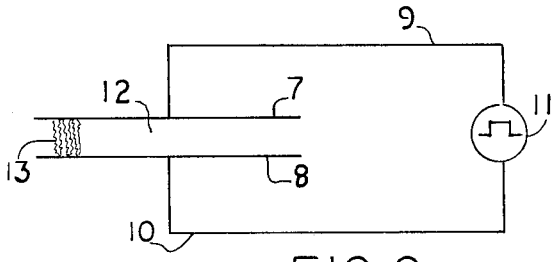
FIG. 2 represents the localized spark between two large area electrodes.
Figure 3:
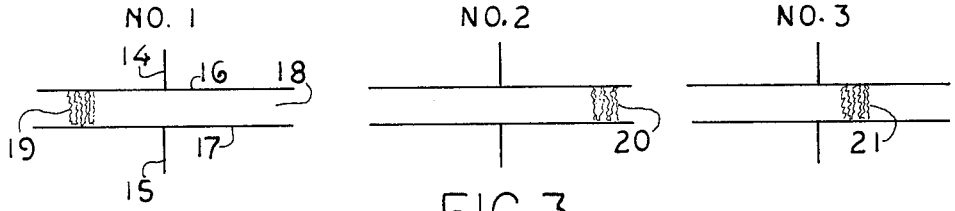
FIG. 3 represents the same device in FIG. 2 for three successive pulses.

FIG. 2 illustrates what happens if the spark plug electrodes of FIG. 1 are replaced by a relatively large area pair of electrodes 7 and 8. The electrodes are connected to a source of pulsed high voltage 11 by conductors 9 and 10. The interelectrode volume is 12, but the arc or spark discharge 13 will be found to localize in one small area that happens to present the least electrical resistance. FIG. 3 shows that the spark will "dance" around from pulse to pulse. Thus pulse number 1 applied to electrodes 16 and 17 (FIG. 3) fed via conductors 14 and 15 will discharge at 19 in interelectrode volume 18. The pulsed high voltage is not shown. The discharge at 19 heats up the gas locally and 19 no longer is the path of least electrical resistance. Thus, pulse 3 dances over to location 21, etc. All the discharges shown in FIGS. 1, 2 and 3 are hot sparks and are sufficient to cause ignition of a combustible gas if the voltage pulse is high enough.

Figure 4:
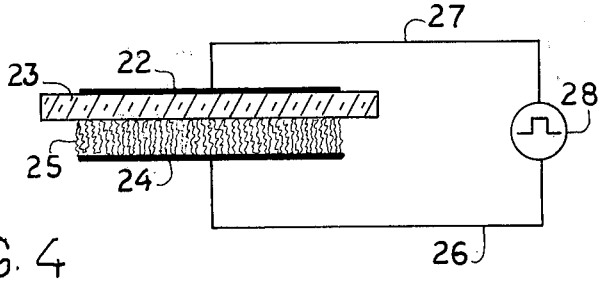
FIG. 4 represents a dielectric stabilized corona discharge.

FIG. 4 shows a stabilized corona discharge. A dielectric 23 which may be a sheet of borosilicate glass is inserted between electrodes 22 and 24. The electrodes are connected to a source of high voltage pulses 28 by conductors 26 and 27. The corona or brush discharge is found to be uniform over the interelectrode volume 25. However, the uniform and diffuse discharge in FIG. 4 is found to be too cool to provide ignition energy for a combustible gas.

Figure 5:
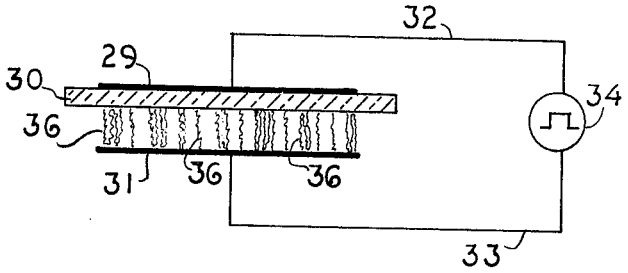
FIG. 5 represents a plasma ceramic stabilized spark discharge.

FIG. 5 illustrates the main teaching of the present invention. Plasma ceramic coating 30 applied to electrode 29 is used with a second electrode 31 to form an electrical discharge. The second electrode 31 may be uncoated or coated with flame sprayed ceramic. Upon applying pulsed high voltage 34 to electrodes 29 and 31 via conductors 32 and 33, it has been discovered that a relatively hot spark discharge will occur at each random pore in the plasma ceramic coating. These individual localized sparks are indicated as 36 in FIG. 5. Thus, it has been discovered that the relatively porous plasma ceramic coating provides a discharge somewhere in between the hot localized discharge (FIGS. 2 and 3) and cool diffuse discharge (FIG. 4). In short, a more-or-less uniformly distributed series of hot sparks appear, with each voltage pulse, over the entire interelectrode volume.

Figure 6:
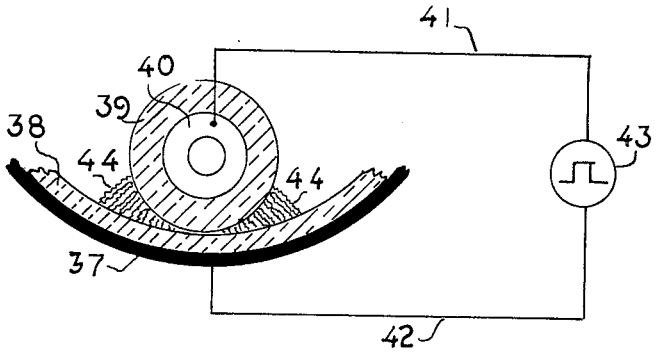
FIG. 6 represents a plasma ceramic stabilized spark discharge for cylindrical electrodes.

FIG. 6 shows a similar situation wherein a plasma ceramic coating is used to quasi-stabilize an electric spark discharge with cylindrical electrodes. Cylinder (into the paper) 37 represents a metallic electrode with plasma ceramic coating 38. Metallic cylindrical electrode 40 is similarly coated with plasma ceramic 39. Pulsed high voltage source 43 is connected to electrodes 40 and 37 by conductors 41 and 42. Relatively uniform sparks, corresponding to pore locations in ceramic coatings 38 and 39, will occur in the regions 44. The situation in FIG. 6 may correspond, for example, to the rotor-case geometry in a sliding vane rotary combustion engine.

Figure 7:
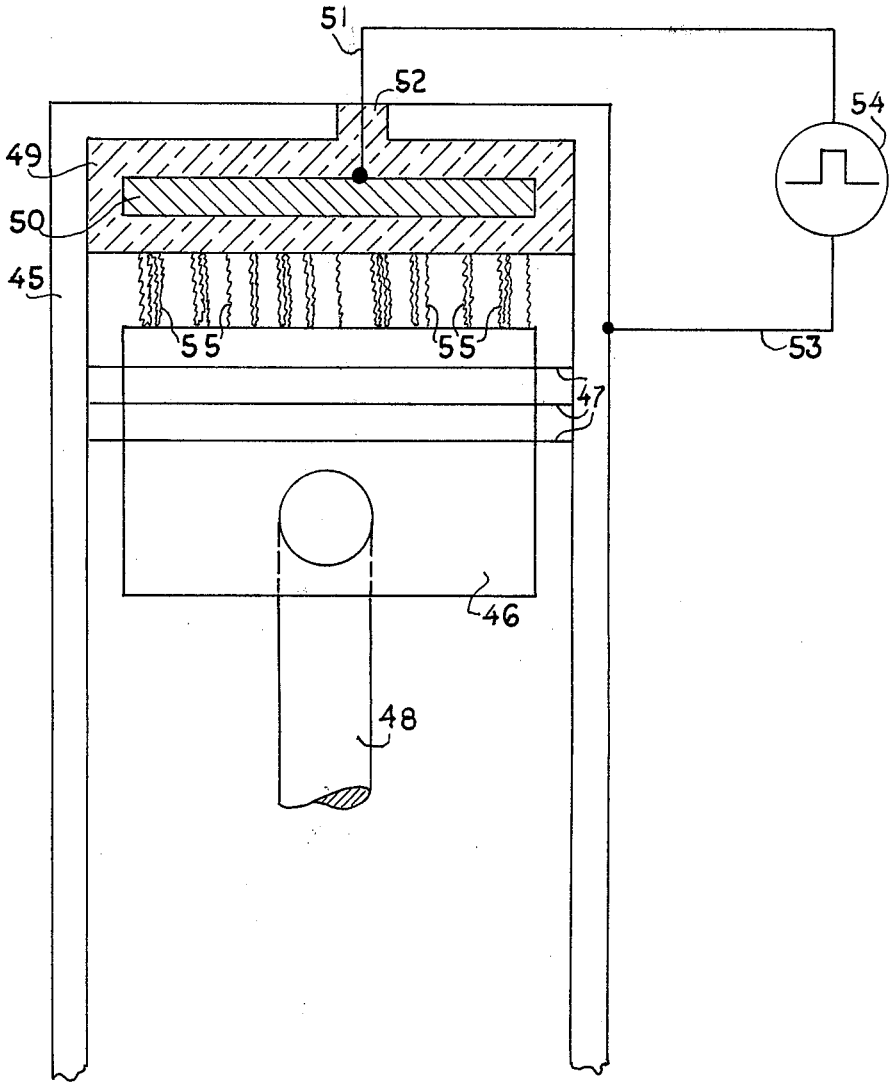
FIGS. 7 and 8 represent wide area spark ignition systems for piston engines.

FIG. 7 represents the typical geometry for a piston engine embodiment of the present invention. Exhaust valves and fuel/oxidant injectors are not shown for simplicity. Working piston 46 including connecting rod 48 is included in cylinder 45 and shown as being near top dead center (TDC). Piston rings 47 provide the standard rings function. Plasma ceramic coating 49 in head of cylinder has a thin layer of flame sprayed metal 50 completely imbedded in ceramic 49. A conductor 51 connects metallic conductor 50 to the pulsed high voltage source 54. Bushing 52 insulates conductor 51 from cylinder structure. The head-cylinder block assembly including head gasket, also is not shown for simplicity. The other connection to voltage source 54 is made to the cylinder 45. As the piston approaches TDC, the electric discharge working between conductor 50 and metallic piston head 46 and stabilized by plasma ceramic 49, will occur as more-or-less uniformly, yet randomly distributed localized hot spark discharges 55 throughout the combustion chamber volume.

Figure 8:
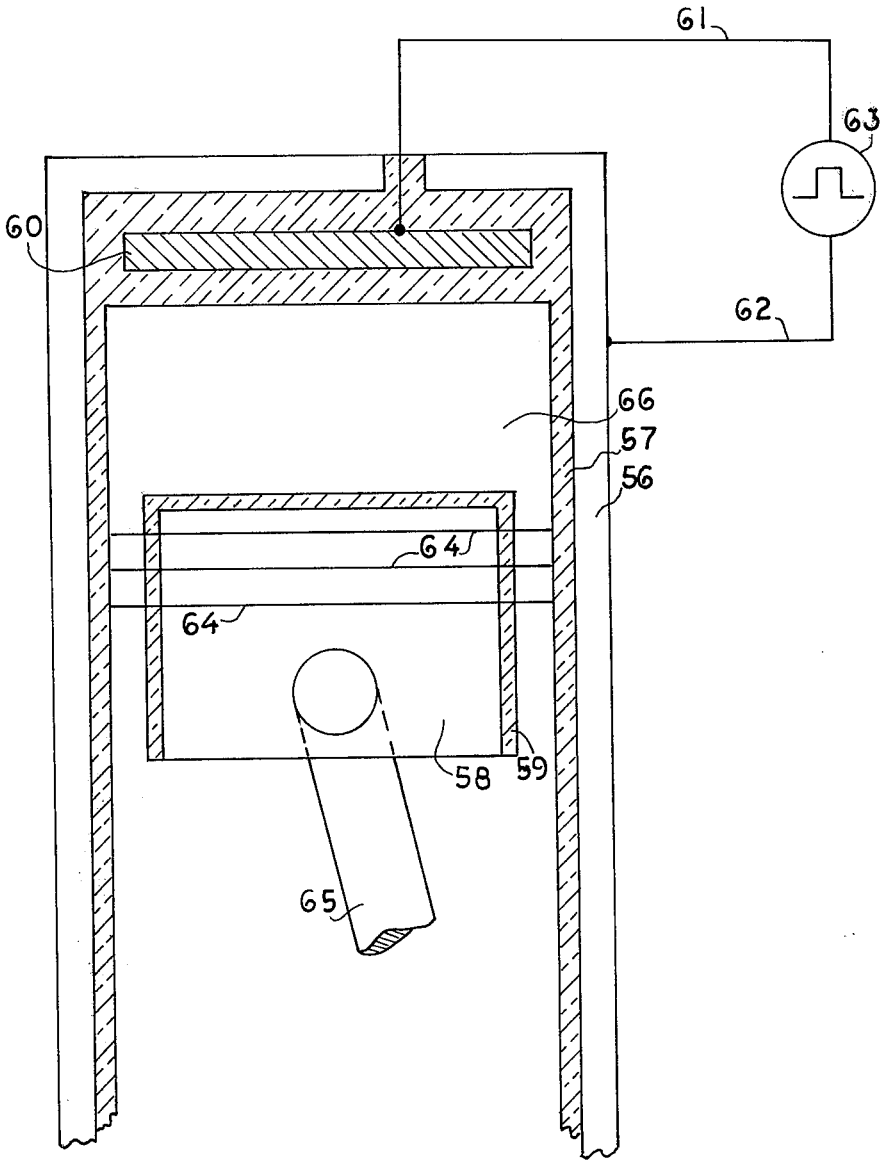

FIG. 8 is another embodiment wherein plasma ceramic coating is used to reduce wear and friction and to reduce heat loss. We note that the liquid oxidant preferred engine of the present invention is highly efficient. Therefore, large amounts of waste heat are not present and it is desirable to keep the heat in as opposed to getting the heat out as is the case in the prior art. Cylinder 56 (FIG. 8) is plasma ceramic coated 57 that provides a high wearing surface for piston rings 64 to ride on. Piston 58 including connecting rod 65 is plasma ceramic coated 59. Metallic conductor 60 is imbedded in plasma ceramic coating 57 and is connected to pulsed high voltage source 63 by conductor 61. The other conductor to voltage source 63 is connected to cylinder 56. The piston shown is not near TDC and, therefore, no electric discharge occurs between metallic conductor 60 and metallic piston 58. As piston 58 approaches TDC, the gap between piston 58 and metallic conductor 60 is reduced to where localized, uniformly spaced hot sparks appear throughout the combustion chamber volume 66, due to stabilizing action of plasma ceramic coatings 57 and 59 that appear between metallic piston 58 and conductor 60.

What is claimed is:

1. An ignition system for an internal combustion engine in which a piston reciprocates in a combustion chamber between a top dead center position and a bottom dead center position, said ignition system including:

electrical discharge means to provide an electrical discharge from an extended interior area of said combustion chamber to an extended area of said piston to initiate ignition in said combustion chamber, whereby said discharge occurs substantially throughout the volume of said combustion chamber.

2. An internal combustion engine as defined in claim 1 in which said electrical discharge means includes a first extended electrode member disposed on said extended interior area of said combustion chamber, said first electrode member including a conductor element overcoated with a porous ceramic material and electrically connected to a voltage source.

3. An internal combustion engine as defined in claim 2 in which said ceramic material is a plasma ceramic coating.

4. An ignition system for an internal combustion engine in which a piston reciprocates in a combustion chamber between a top dead center position and a bottom dead center position, said ignition system including:

electrical discharge means to provide an electrical discharge from a first electrode of extended area disposed within said combustion chamber to a second electrode of extended area disposed on the face of said piston, said first electrode including a conductor element overcoated with a porous ceramic material, whereby the electrical discharge from said first to said second electrode is randomly spatially distributed over the areas thereof, thereby to effect a degree of uniformity of distribution of said electrical discharge throughout the volume of said combustion chamber.

5. An ignition system as defined in claim 4 in which said second electrode is the face of said piston and is overcoated with a porous ceramic material.

* * * * *